US005225094A

United States Patent [19]

Pillon et al.

[11] Patent Number: 5,225,094

[45] Date of Patent: Jul. 6, 1993

[54] LUBRICATING OIL HAVING AN AVERAGE RING NUMBER OF LESS THAN 1.5 PER MOLE CONTAINING A SUCCINIC ANHYDRIDE AMINE RUST INHIBITOR

[75] Inventors: Lilianna Z. Pillon, Sarnia; Andre E. Asselin, Forest; Gerald A. MacAlpine, Sarnia, all of Canada

[73] Assignee: Exxon Research and Engineering Company, Florham Park, N.J.

[21] Appl. No.: 809,907

[22] Filed: Dec. 18, 1991

[51] Int. Cl.[5] ..... C10M 101/02; C10M 133/04; C10M 133/06

[52] U.S. Cl. ..... 252/51.5 R

[58] Field of Search ..... 252/51.5 R

[56] References Cited

U.S. PATENT DOCUMENTS

| | | | |
|---|---|---|---|
| Re. 33,658 | 8/1991 | Ward et al. | 252/52 A |
| 4,360,438 | 11/1982 | Rowan et al. | 252/47.5 |
| 4,687,590 | 8/1987 | Haack | 252/77 |
| 4,777,307 | 10/1988 | Alward et al. | 208/48 AA |
| 4,992,159 | 2/1991 | Cody et al. | 208/27 |

*Primary Examiner*—Jerry Johnson

*Attorney, Agent, or Firm*—John W. Ditsler; James H. Takemoto

[57] ABSTRACT

The rust inhibition capability of a lubricating oil having an average ring number per mole of less than 1.5 can be enhanced by adding a rust inhibitor that is capable of reducing the oil/water interfacial tension to between about 1 to about 4 mN/m.

6 Claims, No Drawings

LUBRICATING OIL HAVING AN AVERAGE RING NUMBER OF LESS THAN 1.5 PER MOLE CONTAINING A SUCCINIC ANHYDRIDE AMINE RUST INHIBITOR

BACKGROUND OF THE INVENTION

1. Field of the Invention

This invention concerns the use of a particular rust inhibitor to inhibit rust formation in lubricating oils formulated from highly saturated base oils.

2. Description of Related Art

Many lubricating oils require the presence of rust inhibitors to inhibit or prevent rust formation, which often occurs due to water contacting a metal surface. Until now, the industry has assumed that all commercially available rust inhibitors are capable of protecting a metal surface from water. However, rust inhibitors presently available in the marketplace were developed for conventionally processed basestocks that contain significant amounts of aromatic and polar compounds and relatively small amounts of saturates.

Surprisingly, we have found that most commercially available rust inhibitors are ineffective in preventing rust in lubricating oils formulated from highly saturated basestocks.

SUMMARY OF THE INVENTION

In one embodiment, this invention concerns a lubricating oil capable of inhibiting rust formation which comprises:

(a) a lubricating oil basestock having an average ring number per mole of less than 1.5, and (b) an oil soluble rust inhibitor capable of reducing the interfacial tension between the oil and water in the oil to from about 1 to about 4 mN/m.

In another embodiment, this invention concerns a method for inhibiting rust formation in an internal combustion engine by lubricating the engine with the oil described above.

DETAILED DESCRIPTION OF THE INVENTION

This invention requires a major amount of a particular lubricating oil basestock and a minor amount of a particular oil soluble rust inhibitor.

The lubricating oil basestocks used in this invention must have an average ring number per mole of less than 1.5. Such basestocks are usually "highly saturated" in that they contain at least about 95 wt.%, most preferably at least 98 wt.%, saturates (i.e. less than 2 wt.% aromatic and polar compounds). These basestocks include slack wax isomerates and polyalphaolefins. Preferably, the average ring number per mole should be less than 1, more preferably less than about 0.5, and most preferably 0.3 or less.

Slack wax is the oily wax from dewaxing conventional hydrocarbon oils. By slack wax isomerate is meant the lubes fraction that remains following dewaxing the isomerate formed from isomerizing slack wax in the presence of a suitable catalyst under isomerization conditions.

Isomerization is conducted over a catalyst containing a hydrogenating metal component—typically one from Group VI, or Group VIII, or mixtures thereof, preferably Group VIII, more preferably noble Group VIII, and most preferably platinum on a halogenated refractory metal oxide support. The catalyst typically contains from 0.1 to 5.0 wt.%, preferably 0.1 to 1.0 wt.%, and most preferably from 0.2 to 0.8 wt.% metal. The halogenated metal oxide support is typically an alumina (e.g. gamma or eta) containing chlorides (typically from 0.1 to 2 wt.%, preferably 0.5 to 1.5 wt.%) and fluorides (typically 0.1 to 10 wt.%, preferably 0.3 to 0.8 wt.%).

Isomerization is conducted under conditions of temperatures between about 270° to 400° C. (preferably between 300° to 360° C.), at pressures of from 500 to 3000 psi $H_2$ (preferably 1000–1500 psi $H_2$), at hydrogen gas rates of from 1000 to 10,000 SCF/bbl, and at a space velocity in the range of from 0.1 to 10 v/v/hr, preferably from 1 to 2 v/v/hr.

Following isomerization, the isomerate may undergo hydrogenation to stabilize the oil and remove residual aromatics. The resulting product may then be fractionated into a lubes cut and fuels cut, the lubes cut being identified as that fraction boiling in the 330° C.+ range, preferably the 370° C.+ range, or even higher. This lubes fraction is then dewaxed to reduce the pour point, typically to between about −15° to about −24° C. This fraction is the "slack wax isomerate" to which the particular rust inhibitor is added.

Essentially any rust inhibitor can be used in this invention provided it is oil soluble and capable of reducing the interfacial tension between the oil and water in the oil to from about 1 to about 4, preferably to from about 1.5 to about 2.5, mN/m, as measured by ASTM Test Method D971-82.

The amount of rust inhibitor added need only be an amount that is necessary to impart rust inhibition performance to the oil; i.e. a rust inhibiting amount. Broadly speaking, this corresponds to using at least about 0.06 wt.% of the inhibitor, with the amount of inhibitor used typically ranging from about 0.06 to about 0.25 wt.%, preferably from about 0.08 to about 0.15 wt.%.

As shown in the following examples, rust inhibitors suitable for use in this invention are commercially available. As such, so is their method of preparation.

If desired, other additives known in the art may be added to the lubricating oil basestock. Such additives include dispersants, antiwear agents, antioxidants, corrosion inhibitors, detergents, pour point depressants, extreme pressure additives, viscosity index improvers, friction modifiers, and the like. These additives are typically disclosed, for example, in "Lubricant Additives" by C. V. Smalhear and R. Kennedy Smith, 1967, pp. 1–11 and in U.S. Pat. No. 4,105,571, the disclosures of which are incorporated herein by reference.

A lubricating oil containing the rust inhibitors described above can be used in essentially any application where rust inhibition is required. Thus, as used herein, "lubricating oil" (or "lubricating oil composition") is meant to include automotive crankcase lubricating oils, industrial oils, gear oils, transmission oils, and the like. In addition, the lubricating oil composition of this invention can be used in the lubrication system of essentially any internal combustion engine, including automobile and truck engines, two-cycle engines, aviation piston engines, marine and railroad engines, and the like. Also contemplated are lubricating oils for gas-fired engines, alcohol (e.g. methanol) powered engines, stationary powered engines, turbines, and the like.

This invention may be further understood by reference to the following examples, which include a preferred embodiment of the invention. In the examples, the oil/water interfacial tension and rust protection were measured using ASTM Test Methods D971-82 and D665B, respectively, the disclosures of which are incorporated herein by reference.

EXAMPLE 1

Rust Protection of Various Rust Inhibitors

Rust protection tests were performed on several samples of a slack wax isomerate basestock (SWI) containing various concentrations of several commercially available rust inhibitors. The results of these tests are shown in Table 1 below.

TABLE 1

| Rust Inhibitor | Concentration, Wt. % | Rust Test Result Pass/Fail |
|---|---|---|
| Neat SWI (1) | — | Fail |
| Lz 850 (2) | 0.05 | Fail |
| (Alkyl Succinic Acid) | 0.10 | Fail |
| | 0.15 | Fail |
| Lz 859 (2) | 0.05 | Fail |
| (Partially Esterified | 0.10 | Fail |
| Alkyl Succinic Acid) | 0.15 | Fail |
| Hitec 536 (3) | 0.05 | Fail |
| (Polyamine) | 0.10 | Fail |
| | 0.15 | Fail |
| Lz 52 (2) | 0.30 | Fail |
| (Calcium Sulphonate) | 0.50 | Fail |
| | 0.70 | Fail |
| NaSul BSN (4) | 0.30 | Fail |
| (Sodium Sulphonate) | 0.50 | Fail |
| | 0.70 | Fail |
| Vanlube RI-A (5) | 0.05 | Fail |
| (Dodecyl Succinic Acid) | 0.15 | Fail |
| | 0.25 | Fail |
| Mobilad C603 (6) | 0.05 | Fail |
| (Succinic Anhydride | 0.06 | Pass |
| Amine Solution) | 0.10 | Pass |
| | 0.15 | Pass |

(1) A slack wax isomerate having a viscosity of 29.4 cSt at 40° C., a viscosity index of 143, greater than 99.5 wt. % saturates, an initial boiling point of 341° C., a mid boiling point of 465° C., and a final boiling point of 570° C.
(2) Available from The Lubrizol Corporation.
(3) Available from Ethyl Petroleum Additives, Inc.
(4) Available from King Industries.
(5) Available from R. T. Vanderbilt Company, Inc.
(6) Available from Mobil Chemical Company.

The data in Table 1 show that only Mobilad C603 at a concentration of about 0.06 wt.% or more provided effective rust protection.

EXAMPLE 2

Oil/Water Interfacial Tension of the Rust Inhibitors in Example 1

The oil/water interfacial tension was determined for the samples in Example 1 that contained 0.15 wt.% of the rust inhibitor. Different base oils and their blends require different equilibration times to achieve a constant value. Therefore it is necessary to repeat the measurements after certain periods of time, with longer times being more representative of the interfacial tension of the particular sample tested. The results of these tests are shown in Table 2 below.

TABLE 2

| | Oil/Water Interfacial Tension (yo/w) | | |
|---|---|---|---|
| Rust Inhibitors | after 5 min (mN/m) | after 30 min (mN/m) | after 60 min (mN/m) |
| Neat SWI | 54.7 | 55.4 | 54.8 |
| Lz 850 | 8.3 | 8.3 | 8.1 |
| Lz 859 | 7.5 | 7.2 | 7.1 |
| Hitec 536 | 4.4 | 3.6 | 3.7 |
| Lz 52 | 3.8 | 4.9 | 4.7 |
| NaSul BSN | 5.9 | 6.1 | 6.1 |

TABLE 2-continued

| | Oil/Water Interfacial Tension (yo/w) | | |
|---|---|---|---|
| Rust Inhibitors | after 5 min (mN/m) | after 30 min (mN/m) | after 60 min (mN/m) |
| Vanlube RI-A | 7.8 | 7.1 | 7.4 |
| Mobilad C603 | 2.6 | 2.5 | 2.2 |

The data in Table 2 show that the oil/water interfacial tension was lowest for Mobilad C603.

EXAMPLE 3

Rust Inhibitor for White Oil

Rust tests were performed on three different highly saturated basestocks containing two different rust inhibitors. The results of these tests are shown in Table 3 below.

TABLE 3

| Properties/Composition | PAO (1) | SWI (2) | Oil 1 (3) |
|---|---|---|---|
| Oil/Water Interfacial Tension (mN/m) | 42.3 | 48.9 | 38.8 |
| Kinematic Viscosity, cSt at 40° C. | 30.4 | 29.4 | 32.7 |
| Viscosity Index | 134 | 143 | 106 |
| Saturates, wt % | >99.5 | >99.5 | >99.5 |
| Aromatics + Polars, wt. % | <0.5 | <0.5 | <0.5 |
| Total Nitrogen, ppm | <1 | <1 | <1 |
| Sulphur, ppm | <1 | <1 | <1 |
| Basic Nitrogen, ppm | 0 | 0 | 0 |
| Rust Test | | | |
| Mobilad C603, 0.06 wt. % | Pass | Pass | Fail |
| Lz 859, 0.1 wt. % | Fail | Fail | Pass |

(1) A polyalphaolefin synthetic base oil obtained by polymerizing a $C_{10}$ monomer to form a mixture of three components: $C_{10}$ trimer ($C_{30}$), $C_{10}$ tetramer ($C_{40}$), and $C_{10}$ pentamer ($C_{50}$). The PAO had an initial boiling point of 408° C., a mid boiling point of 481° C., and a final boiling point of 596° C.
(2) Same as Note 1 in Table 1.
(3) A white oil obtained by high pressure hydrogenation to saturate aromatics and remove essentially any sulfur and nitrogen from conventional base oils. The white oil had an initial boiling point of 340° C., a mid boiling point of 433° C., and a final boiling point of 533° C.

The data in Table 3 show that the Oil 1 failed the rust test using Mobilad C603 while it passed using Lz 859.

EXAMPLE 4

Rust Tests With Other Basestocks

Rust test were performed on the saturate fractions of three different base oils in which the level of aromatics and polar compounds were reduced to less than 2% using column chromatography. The results of these tests are shown in Table 4 below.

TABLE 4

| Base Oils | Oil 2 (1) | Oil 3 (2) | Oil 4 (3) |
|---|---|---|---|
| Original base oils: | | | |
| Viscosity at 40° C., cSt | 111.4 | 105.9 | 301.7 |
| Aromatics + Polars, Wt. % | 18.1 | 18.5 | 28.2 |
| Saturate Fraction: | | | |
| Viscosity at 40° C., cSt | 76.4 | 75.4 | 155.7 |
| Aromatics + Polars, Wt. % | 0.7 | 1.6 | 1.7 |
| Rust Test, 0.1 wt. % | | | |
| Mobilad C603 | Fail | Fail | Fail |

(1) A conventional 600 Neutral NMP extracted base oil which is then solvent dewaxed and hydrofinished. This oil had an initial boiling point of 370° C., a mid boiling point of 488° C., and a final boiling point of 587° C.
(2) A conventional 600 Neutral phenol extracted base oil which is then solvent dewaxed and hydrofinished. This oil had an initial boiling point of 362° C., a mid boiling point of 488° C., and a final boiling point fo 598° C.
(3) A conventional 1400 Neutral phenol extracted base oil which is then solvent dewaxed and hydrofinished. This oil had an initial boiling point of 404 C, a mid boiling point of 543° C., and a final boiling point of 637° C.

The data in Table 4 show that all saturate fractions failed the rust test using Mobilad C603.

EXAMPLE 5

Lubricating Oil Must Have an Average Ring Number Per Mole of Less Than 1.6

A mass spectrometer analysis of the oils tested in Examples 3 and 4 was performed in an attempt to understand why the SWI and PAO passed the rust test using 0.06 wt.% Mobilad C603 while Oils 1–4 did not, even at a higher rust inhibitor concentration and essentially the same saturate content. An analysis was also made of a hydrocrackate base oil. The results of these test are shown in Table 5.

TABLE 5

| Volume % | PAO | SWI | (1) | Oil 1 | Oil 2 | Oil 3 | Oil 4 |
|---|---|---|---|---|---|---|---|
| Paraffin/Isoparaffins | 94.3 | 89.9 | 19.9 | 30.5 | 18.7 | 22.0 | 13.3 |
| 1-Ring Naphthenes | 2.5 | 8.8 | 27.8 | 23.1 | 37.0 | 32.3 | 39.1 |
| 2-Ring Naphthenes | 1.6 | 3.9 | 21.3 | 18.7 | 18.4 | 18.7 | 20.4 |
| 3-Ring Naphthenes | 0.2 | 0.9 | 14.0 | 11.6 | 11.3 | 12.5 | 13.8 |
| 4-Ring Naphthenes | 0.4 | 0.6 | 8.4 | 10.4 | 7.9 | 8.2 | 7.3 |
| 5-Ring Naphthenes | 0.4 | 0.5 | 4.0 | 3.8 | 1.9 | 1.9 | 0.9 |
| 6-Ring Naphthenes | 0.6 | 0.5 | 1.3 | 1.3 | 0.0 | 0.0 | 0.0 |
| Other Ring Structures | 0.0 | 0.0 | 3.1 | 0.7 | 4.7 | 4.4 | 5.2 |
| Total | 100.0 | 100.0 | 100.0 | 100.0 | 100.0 | 100.0 | 100.0 |
| Average Ring Number (per mole) | 0.1 | 0.3 | 1.5 | 1.6 | 1.6 | 1.6 | 1.6 |
| Rust Test, 0.06 wt. % | | | | | | | |
| Mobilad C603 | Pass | Pass | (2) | Fail | Fail | Fail | Fail |

(1) A hydrocrackate base oil produced by hydrocarcking (rather than solvent extracting) the aromatic and polar crude components. The hydrocrackate base oil had a viscosity of 35.4 cSt at 40° C., a viscosity index ov 97, greater than 99.5 wt. % saturates, an initial boiling point of 323° C., a mid boiling point of 426° C., and a final boiling point of 538° C.
(2) Borderline pass.

The data in Table 5 show that effective rust protection occurs if the lubricating oil has an average ring number per mole of less than 1.5.

What is claimed is:

1. A lubricating oil for inhibiting the formation of rust which comprises (a) a hydrocarbon lubricating oil basestock having an average ring number per mole of less than 1.5, and (b) at least about 0.06 wt% of an oil soluble rust inhibitor capable of reducing the interfacial tension between the oil and water in the oil to about 1 to about 4 mN/m wherein the oil soluble rust inhibitor is a succinic anhydride amine.

2. The oil of claim 1 wherein the average ring number per mole in (a) is less than 0.5.

3. The oil of claim 2 wherein the amount of (b) ranges from about 0.06 to about 0.25 wt.%.

4. The oil of claim 3 wherein the average ring number per mole in (a) is 0.3 or less.

5. A method of inhibiting the formation of rust in an internal combustion engine which comprises operating the engine with the lubricating oil of claim 1.

6. The method of claim 5 wherein the average ring number per mole in (a) is less than 0.5.

* * * * *